US010766271B2

(12) United States Patent
Mukoyama et al.

(10) Patent No.: US 10,766,271 B2
(45) **Date of Patent: *Sep. 8, 2020**

(54) INKJET PRINTING APPARATUS

(71) Applicant: CANON KABUSHIKI KAISHA, Tokyo (JP)

(72) Inventors: Yumi Mukoyama, Kawasaki (JP); Junya Kosuge, Kawasaki (JP); Kyoshiro Okude, Kawasaki (JP); Tsuyoshi Saeki, Kawasaki (JP); Ryoma Arai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,411

(22) Filed: Jun. 5, 2019

(65) Prior Publication Data

US 2019/0283443 A1 Sep. 19, 2019

Related U.S. Application Data

(63) Continuation of application No. 16/019,076, filed on Jun. 26, 2018, now Pat. No. 10,357,977.

(30) Foreign Application Priority Data

Jul. 7, 2017 (JP) ..... 2017-133621

(51) Int. Cl.
*B41J 2/175* (2006.01)
*B41J 2/18* (2006.01)
(Continued)

(52) U.S. Cl.
CPC ..... *B41J 2/17596* (2013.01); *B41J 2/175* (2013.01); *B41J 2/1752* (2013.01); *B41J 2/17566* (2013.01); *B41J 2/18* (2013.01); *B41J 2/21* (2013.01); *B41J 29/02* (2013.01); *B41J 29/38* (2013.01); *B41J 29/393* (2013.01);
(Continued)

(58) Field of Classification Search
CPC ..... B41J 2/16517; B41J 2/175; B41J 2/1752; B41J 2/17566; B41J 2/17596; B41J 2/18; B41J 2/21; B41J 29/02; B41J 29/38; B41J 29/393; B41J 2002/17579; B41J 2202/20
See application file for complete search history.

(56) References Cited

U.S. PATENT DOCUMENTS 8,308,263 B2 * 11/2012 Murakami ..... B41J 2/17596 347/14
9,162,507 B2 10/2015 Tanaka et al. ..... B41J 29/393
(Continued)

FOREIGN PATENT DOCUMENTS

JP 2011-240628 12/2011

*Primary Examiner* — Anh T Vo
(74) *Attorney, Agent, or Firm* — Venable LLP

(57) ABSTRACT

In a color inkjet printing apparatus using an ink circulation system, there is provided an inkjet printing apparatus capable of making appropriate circulation control for individual inks without resulting in cost increase. To achieve this, an inkjet printing apparatus includes a plurality of diaphragm pumps for circulating ink within a print head, a sub-tank, a supply flow path, and a collection flow path. The plurality of diaphragm pumps are configured by mounting control members of different types which can press against diaphragm units of a same type.

15 Claims, 16 Drawing Sheets

(51) Int. Cl.

| | |
|---|---|
| ***B41J 2/21*** | (2006.01) |
| ***B41J 29/02*** | (2006.01) |
| ***B41J 29/38*** | (2006.01) |
| ***B41J 29/393*** | (2006.01) |
| *B41J 2/165* | (2006.01) |

(52) U.S. Cl.
CPC .. *B41J 2/16517* (2013.01); *B41J 2002/17579* (2013.01); *B41J 2202/12* (2013.01); *B41J 2202/20* (2013.01)

(56) References Cited

U.S. PATENT DOCUMENTS

| | | | | |
|---|---|---|---|---|
| 9,738,081 | B2 | 8/2017 | Kimura et al. | B41J 2/17509 |
| 10,357,977 | B2 * | 7/2019 | Mukoyama | B41J 2/17596 |
| 2010/0247769 | A1 | 9/2010 | Ooishi et al. | 427/256 |
| 2011/0050794 | A1 | 3/2011 | Koike et al. | 347/22 |
| 2013/0050309 | A1 * | 2/2013 | Koike | B41J 2/175 347/6 |
| 2017/0305163 | A1 | 10/2017 | Kimura et al. | B41J 2/17509 |
| 2017/0326882 | A1 | 11/2017 | Okude et al. | B41J 2/01 |
| 2019/0009557 | A1 | 1/2019 | Arai et al. | B41J 2/17596 |
| 2019/0009562 | A1 | 1/2019 | Abe et al. | B41J 2/16505 |
| 2019/0009563 | A1 | 1/2019 | Tokisawa et al. | B41J 2/17596 |

* cited by examiner

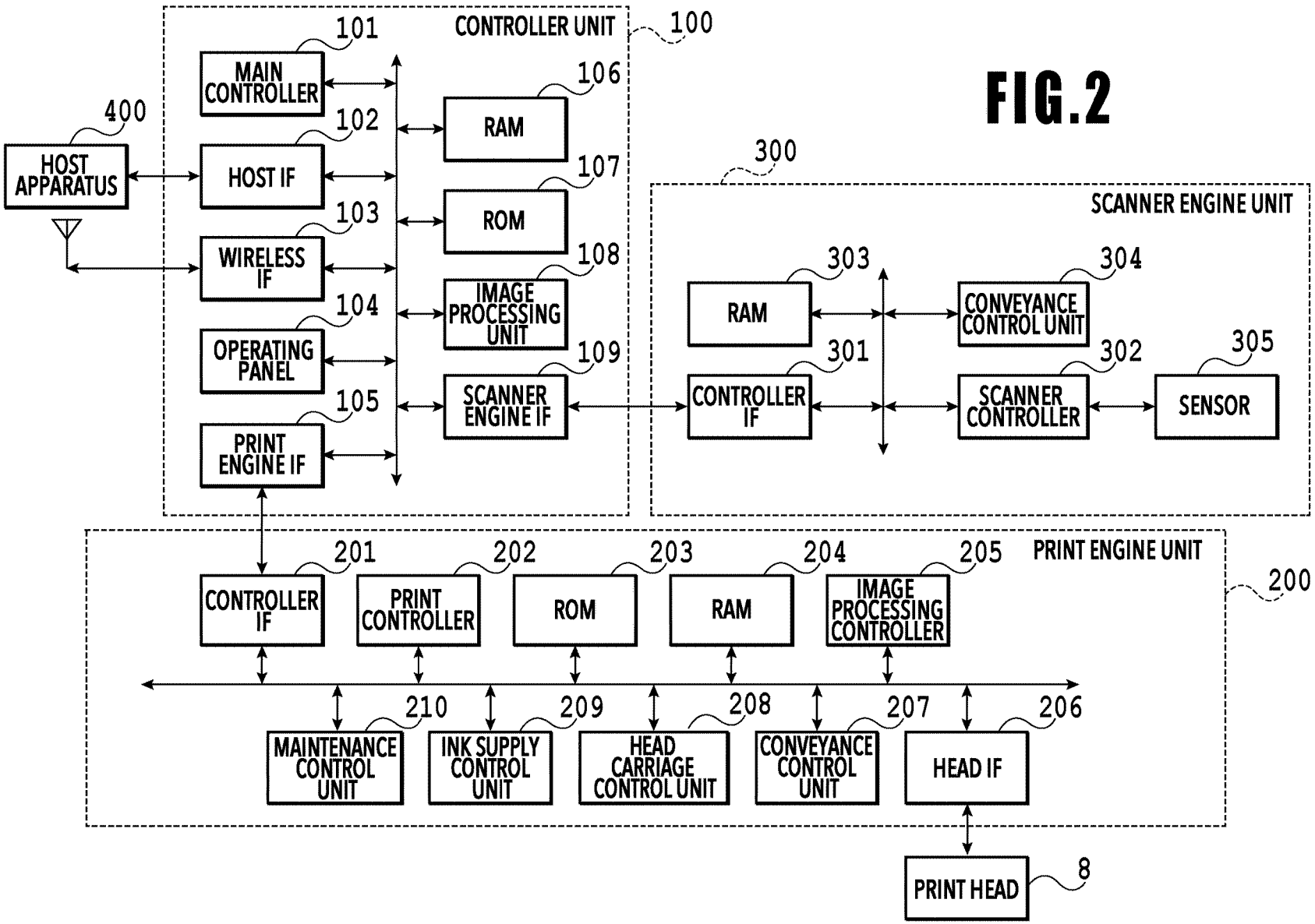
FIG.2
SCANNER ENGINE UNIT
300
305
SENSOR
304
CONVEYANCE CONTROL UNIT
302
SCANNER CONTROLLER
303
RAM
301
CONTROLLER IF
100
CONTROLLER UNIT
106
RAM
107
ROM
108
IMAGE PROCESSING UNIT
109
SCANNER ENGINE IF
101
MAIN CONTROLLER
102
HOST IF
103
WIRELESS IF
104
OPERATING PANEL
105
PRINT ENGINE IF
400
HOST APPARATUS
200
PRINT ENGINE UNIT
205
IMAGE PROCESSING CONTROLLER
204
RAM
203
ROM
202
PRINT CONTROLLER
201
CONTROLLER IF
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
PRINT HEAD

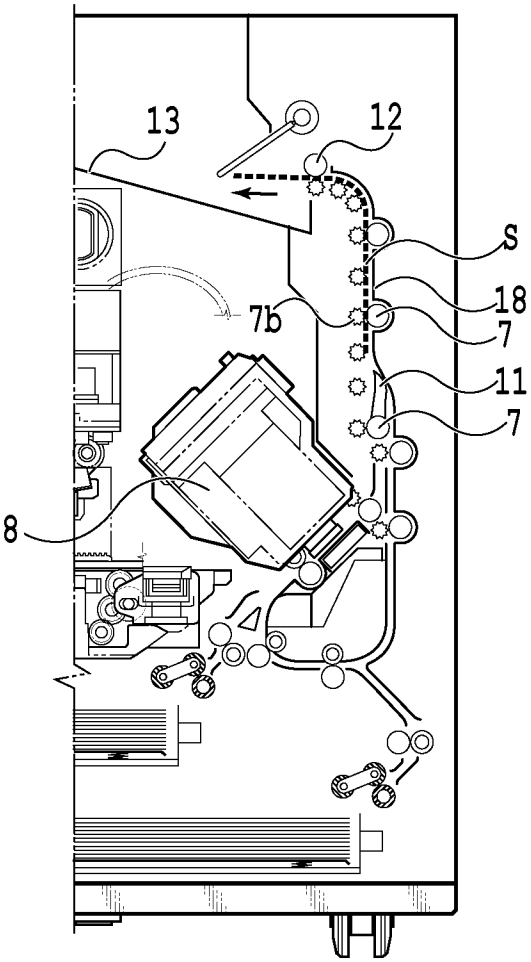
FIG.4C
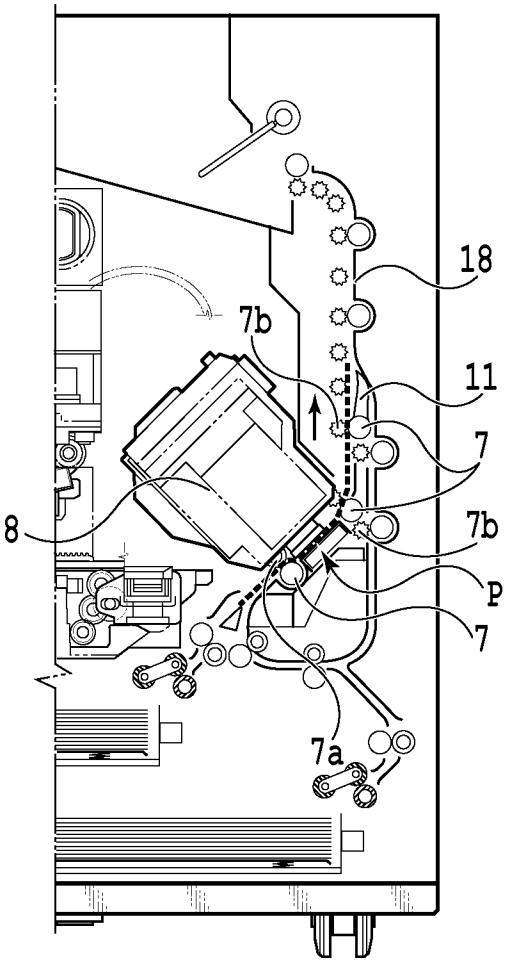
FIG.4B
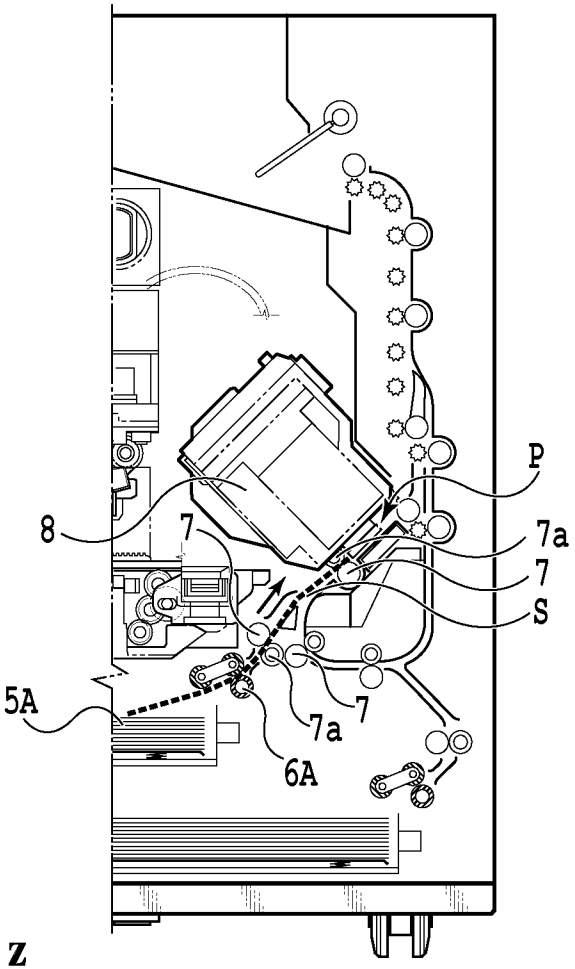
FIG.4A
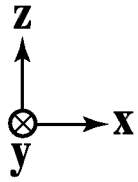

INKJET PRINTING APPARATUS

This application is a continuation of U.S. patent application Ser. No. 16/019,076, filed Jun. 26, 2018, currently pending; and claims the benefit of priority under 35 U.S.C. § 119 of Japan Application No. 2017-133621, filed in Japan on Jul. 7, 2017; the contents of all of which are hereby incorporated by reference as if set forth herein in full.

BACKGROUND OF THE INVENTION

Field of the Invention

The present invention relates to an inkjet printing apparatus including a print head which ejects ink to print an image.

Description of the Related Art

Japanese Patent Laid-Open No. 2011-240628 discloses a configuration of stably supplying ink to a print head irrespective of the frequency of ejection by disposing pumps in a path that supplies ink from a sub-tank to the print head and a path that collects ink from the print head to the sub-tank, respectively.

In a case of using an ink circulation system disclosed in Japanese Patent Laid-Open No. 2011-240628 for a color inkjet printing apparatus, pumps and circulation flow paths need to be prepared by each color. In this case, in terms of space saving and cost reduction, it is preferable that a pump of the same type that serves a common role for each color be used by each color.

Even if common circulation control is made by each color, a degree of ink concentration and degradation per unit time varies depending on the type of ink and the consumption amount of ink also varies depending on a printing mode. In addition, ink with less ejection frequency may possibly increase the viscosity of the entire circulating ink due to frequent circulation beyond necessity. Accordingly, in terms of the stability of an image and the reliability of an apparatus, it is preferable that the flow amount of ink to be circulated in the ink circulation system be appropriately adjusted by each ink.

However, in the conventional ink circulation system, it has been difficult to make appropriate circulation control per ink in a color inkjet printing apparatus without resulting in cost increase.

SUMMARY OF THE INVENTION

The present invention has been made to solve the above problem. Accordingly, an object of the present invention is to provide an inkjet printing apparatus capable of making appropriate circulation control for individual ink in a color inkjet printing apparatus employing an ink circulation system without resulting in cost increase.

According to a first aspect of the present invention, there is provided an inkjet printing apparatus comprising: a tank in which ink is contained; a print head for ejecting ink supplied from the tank; a supply flow path for supplying ink from the tank to the print head; a collection flow path for collecting ink from the print head to the tank; a first diaphragm pump which is provided in the collection flow path; and a second diaphragm pump which is provided in the supply flow path, ink being circulated among the tank, the supply flow path, the print head, and the collection flow path by the first diaphragm pump and the second diaphragm pump, wherein the first diaphragm pump includes a first volume change portion which allows volume changes and a first control member which controls a volume of the first volume change portion, the first diaphragm pump delivering ink in a first flow amount, and the second diaphragm pump includes a second volume change portion having the same volume as the first volume change portion and a second control member which is different from the first control member and controls a volume of the second volume change portion, the second diaphragm pump delivering ink in a second flow amount that is larger than the first flow amount.

According to a second aspect of the present invention, there is provided an inkjet printing apparatus comprising: a print head for ejecting a first ink and a second ink; a first tank in which the first ink is contained; a second tank in which the second ink is contained; a first supply flow path for supplying the first ink from the first tank to the print head; a second supply flow path for supplying the second ink from the second tank to the print head; a first collection flow path for collecting the first ink from the print head to the first tank; a second collection flow path for collecting the second ink from the print head to the second tank; a first pump for circulating the first ink among the first tank, the first supply flow path, the print head, and the first collection flow path; and a second pump for circulating the second ink among the second tank, the second supply flow path, the print head, and the second collection flow path, wherein the first pump and the second pump are driven by a common driving source, and the inkjet printing apparatus further comprises a switching unit for switching between a first mode for driving the first pump and the second pump and a second mode for driving the first pump and not driving the second pump.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
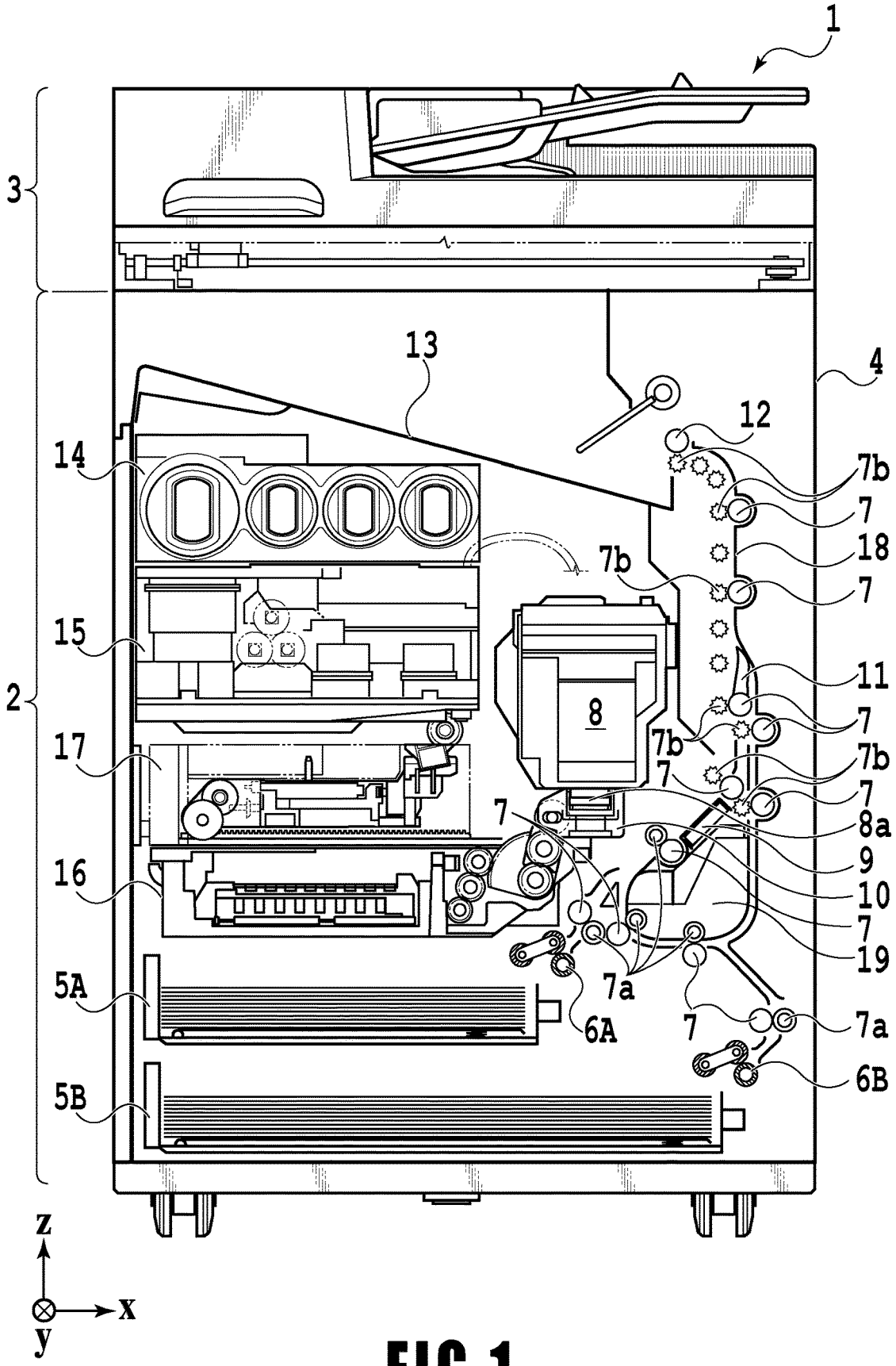
FIG. 1 is a diagram of an internal configuration of an inkjet printing apparatus 1.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. However, the present invention is not limited to the full line type inkjet print head, and is also applicable to a serial type inkjet print head which performs printing by reciprocating for ejecting ink. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow amount of ink in the print head 8 within a suitable range. The present embodiment adopts a circulation type ink supply system, where the ink supply unit 15 adjusts the pressure of ink supplied to the print head 8 and the flow amount of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
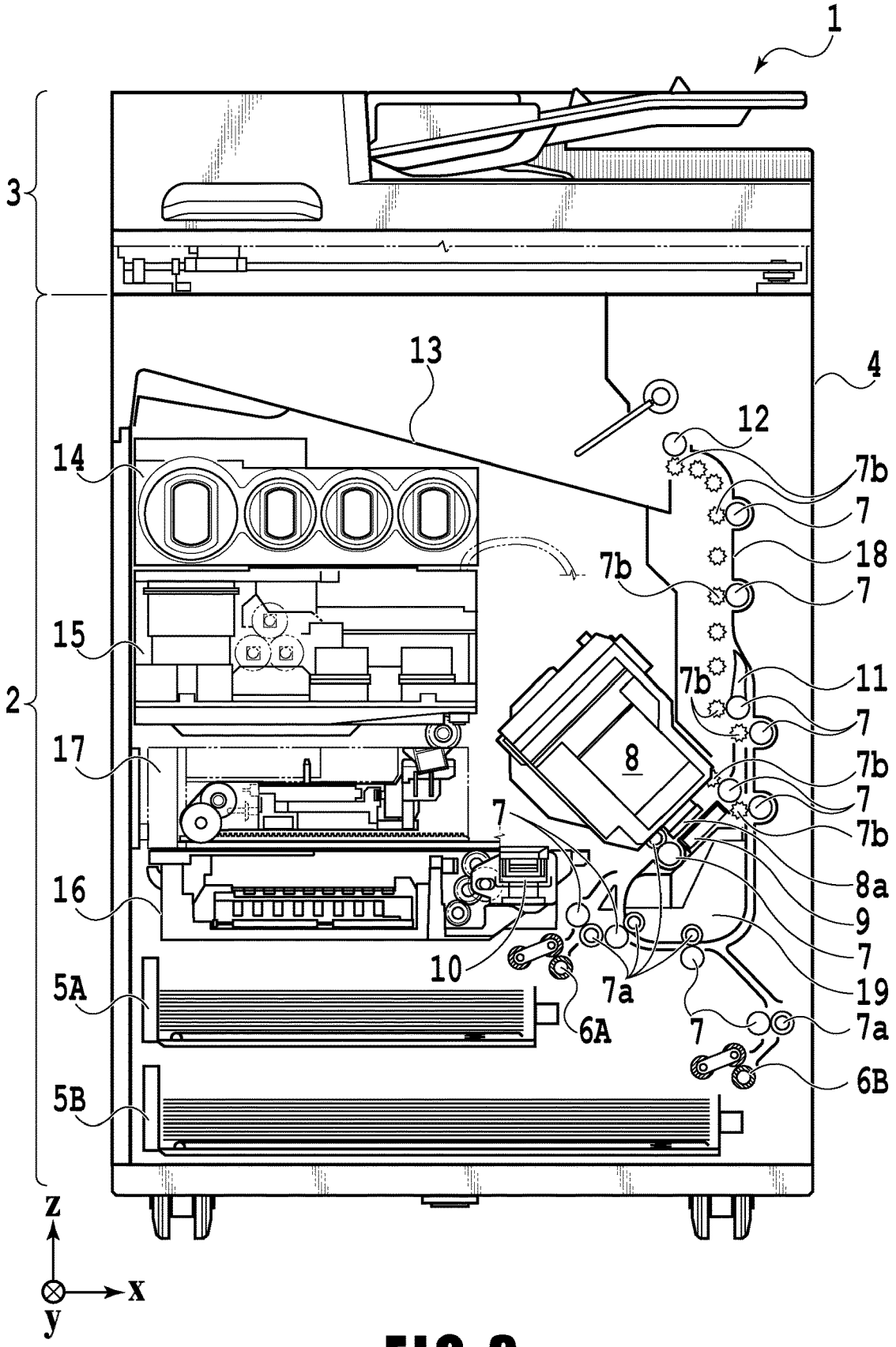
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 facing down.

Figure 5C:
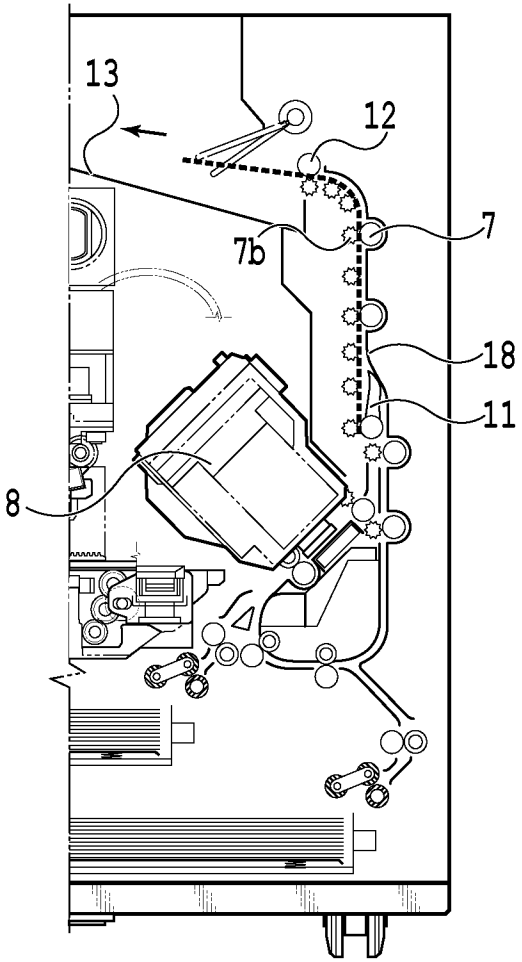
FIGS. 5A to 5C are conveying path diagrams of a print medium fed from a second cassette.
Figure 5B:
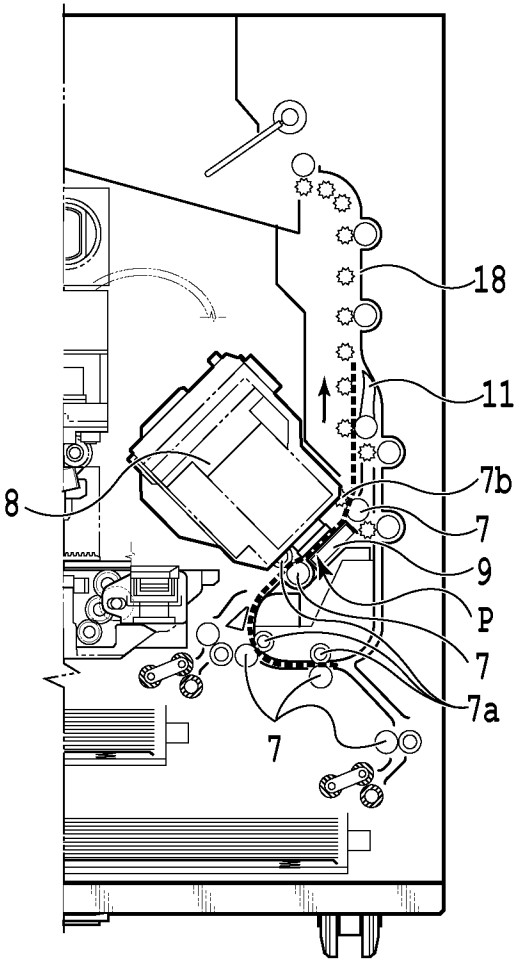
Figure 5A:
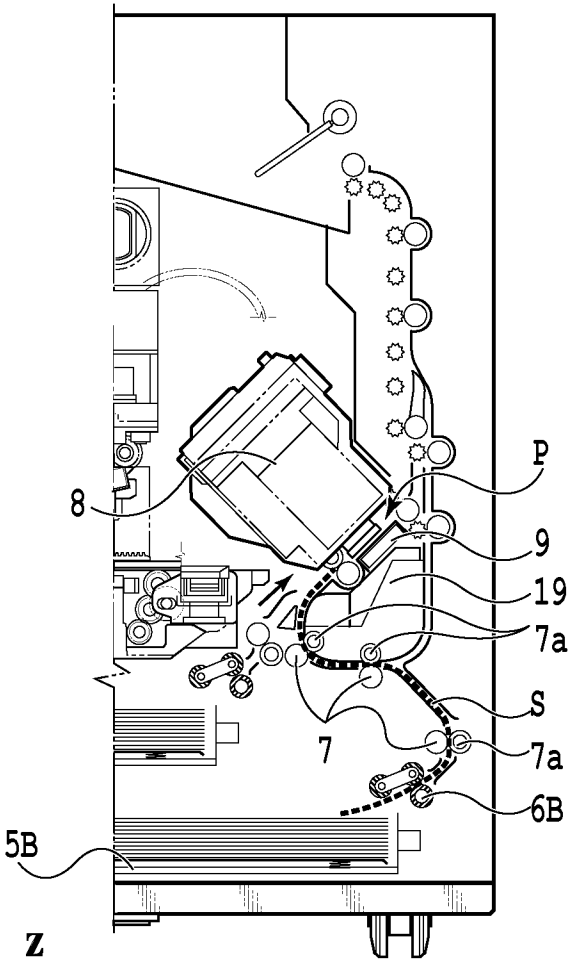

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
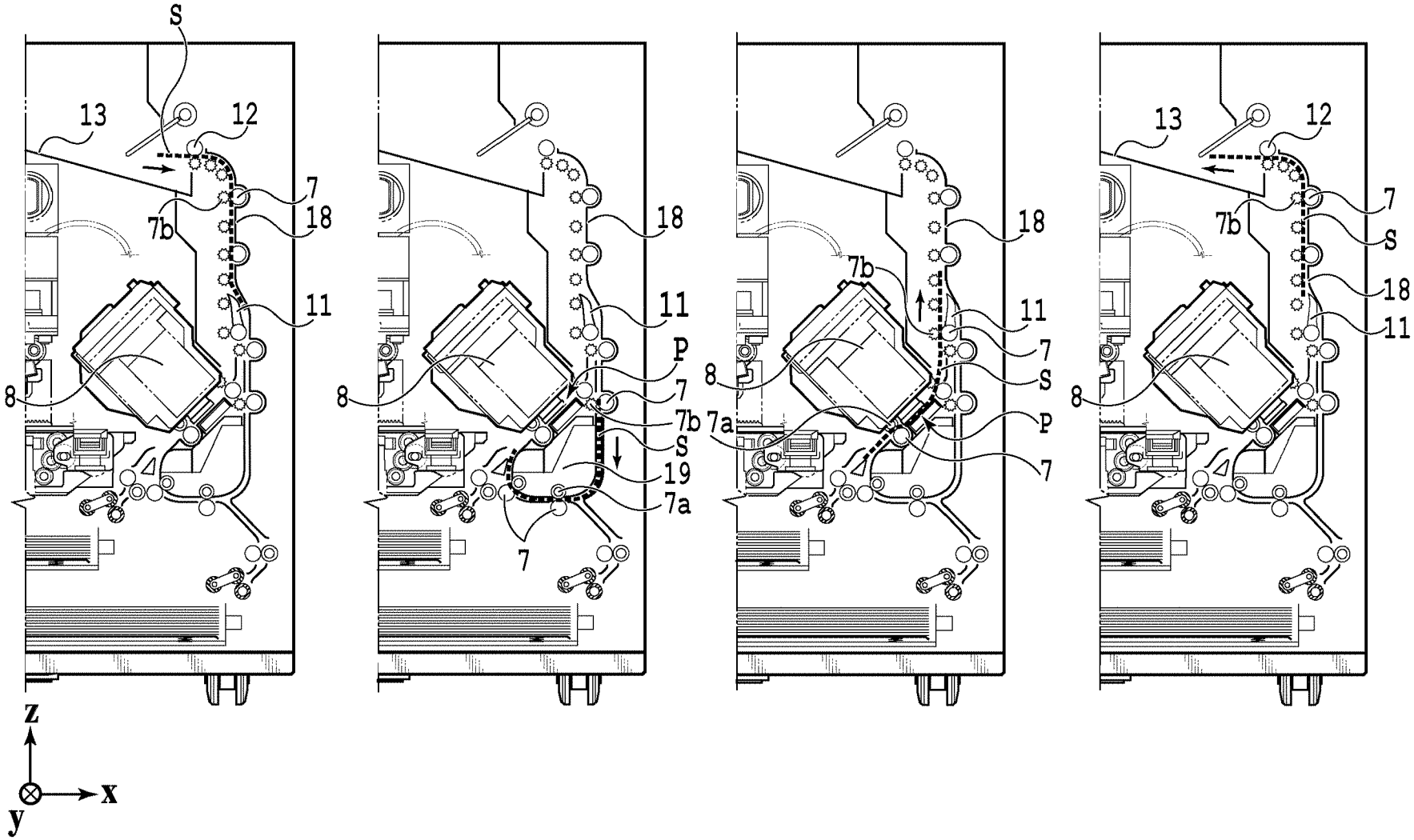
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
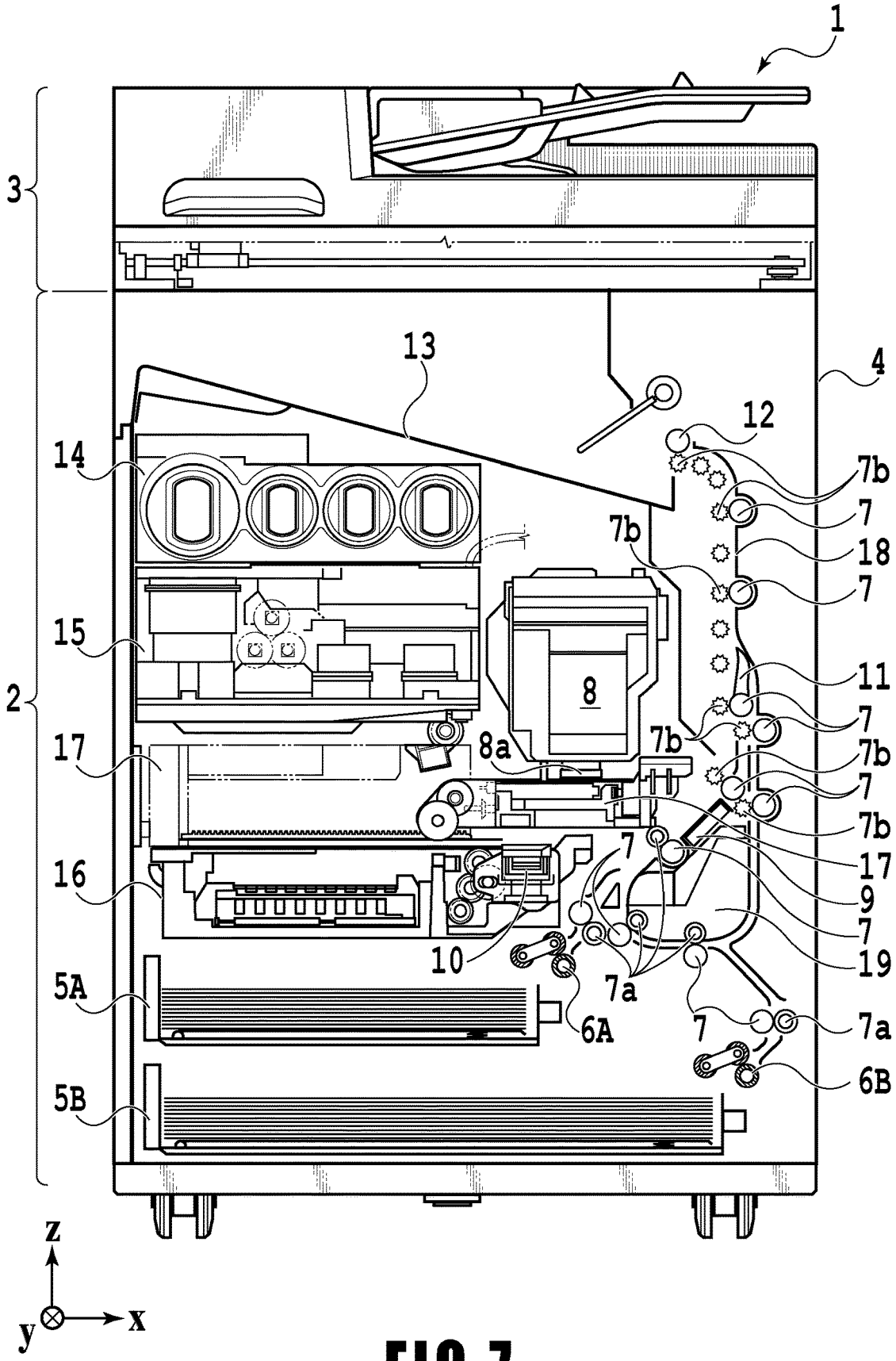
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
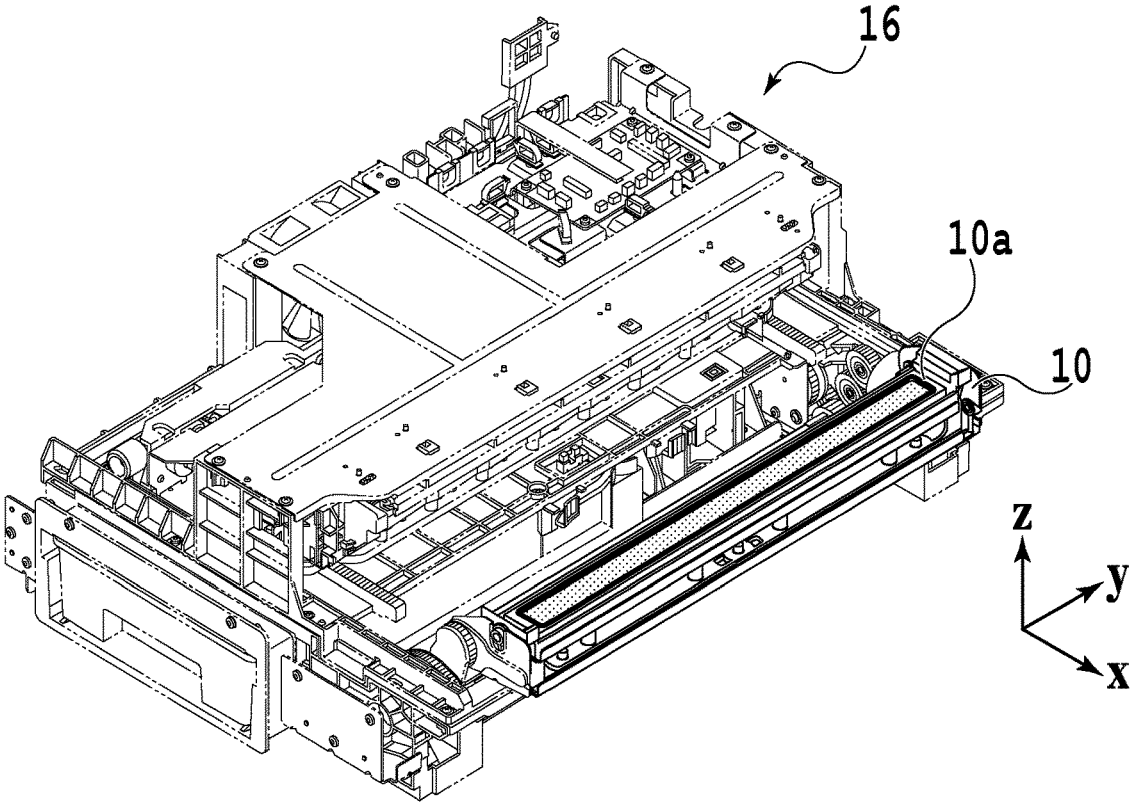
FIGS. 8A and 8B are perspective views showing the configuration of a maintenance unit.
Figure 8B:
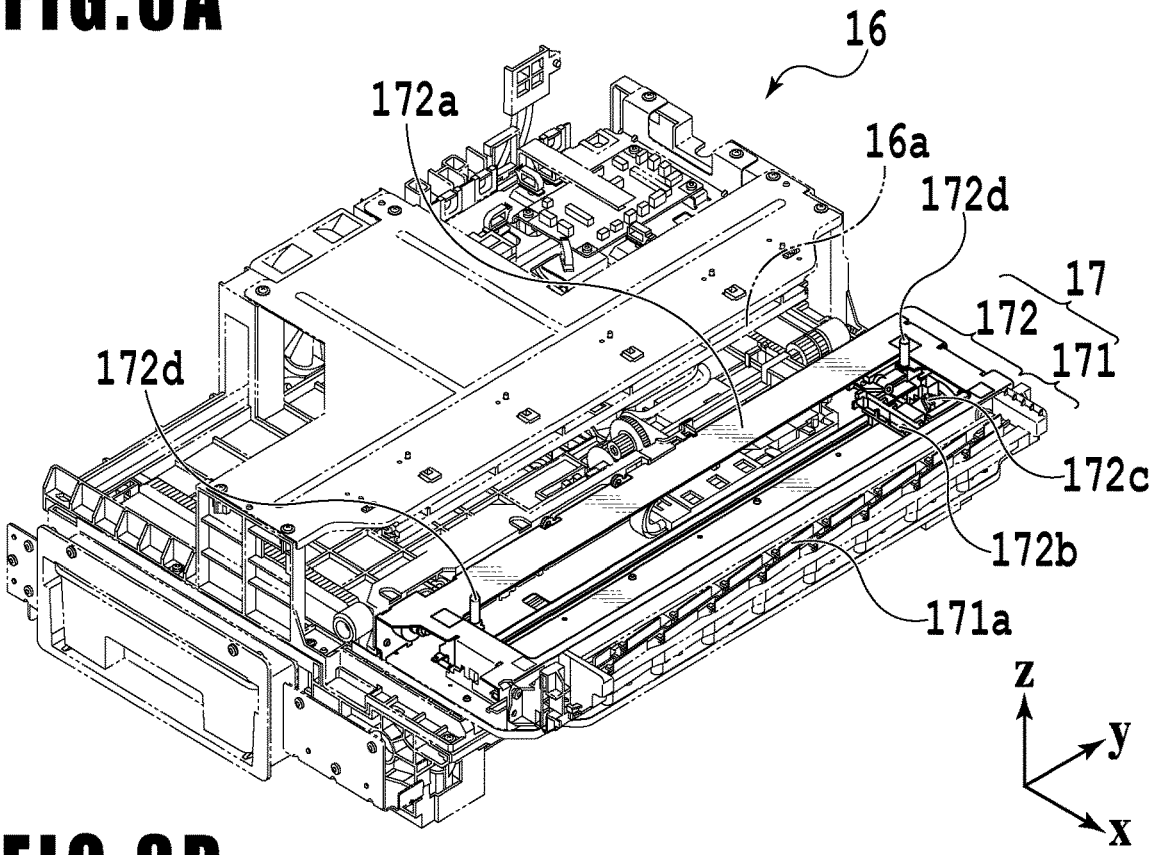

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units (wiping members): a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping processes. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and suction operation of collected ink in the same manner as the first wiping process.

Figure 9:
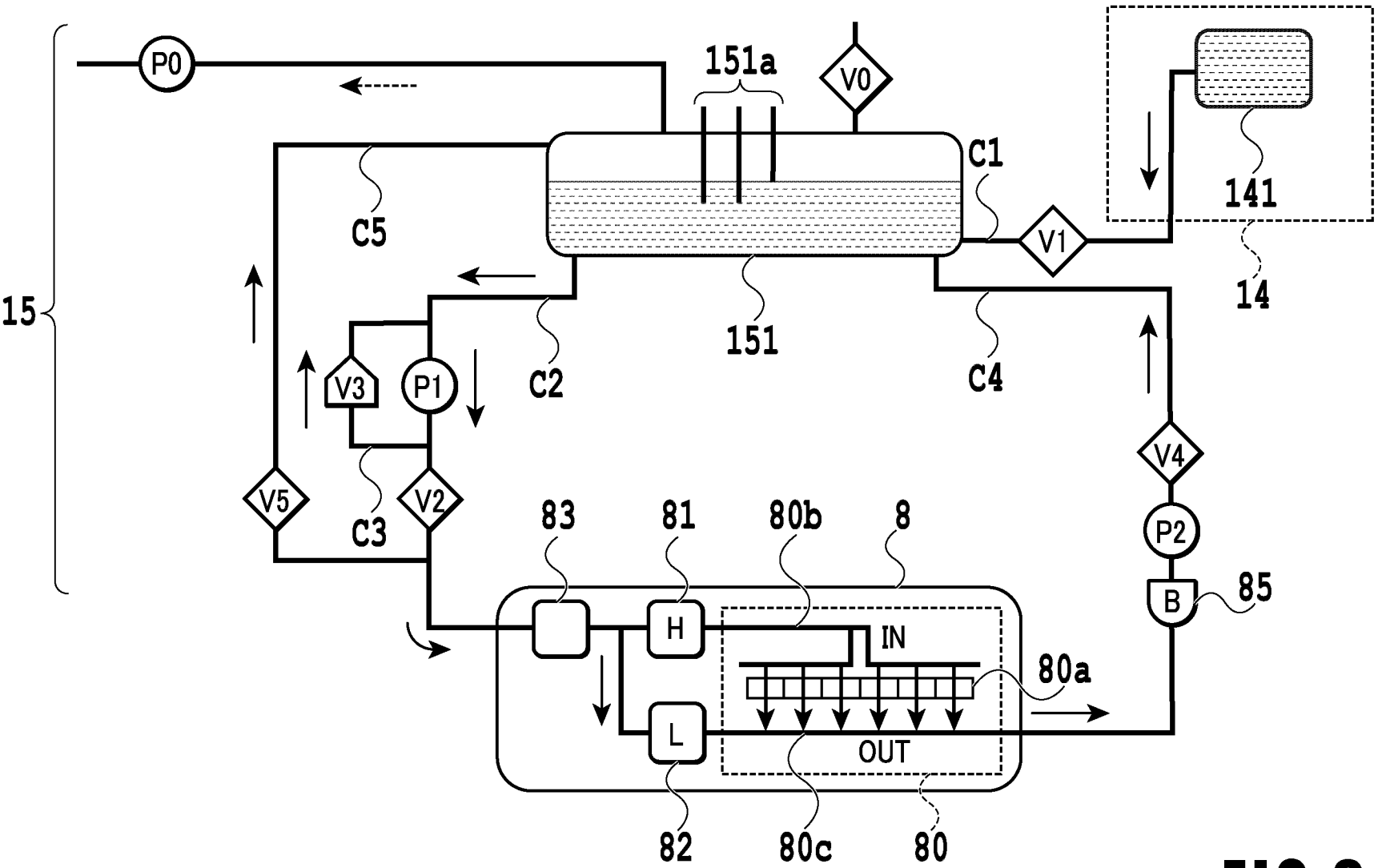
FIG. 9 is a diagram showing an ink supply system.

FIG. 9 is a diagram showing an ink supply system including the ink supply unit 15 adopted in the inkjet printing apparatus 1 of the present embodiment. With reference to FIG. 9, a flow path configuration of an ink circulation system of the present embodiment will be described. The ink supply unit 15 is a configuration of supplying ink from the ink tank unit 14 to the print head 8. In the diagram, a configuration of one color ink is shown, but such a configuration is practically prepared for each color ink. The ink supply unit 15 is basically controlled by the ink supply control unit 209 shown in FIG. 2. Each configuration of the unit will be described below.

Ink is circulated mainly between a sub-tank 151 and the print head 8 (a head unit in FIG. 9). In the head unit 8, ink ejection operation is performed based on image data and ink that has not been ejected is collected and flows back to the sub-tank 151.

The sub-tank 151 in which a certain amount of ink is contained is connected to a supply flow path C2 for supplying ink to the head unit 8 and to a collection flow path C4 for collecting ink from the head unit 8. In other words, a circulation path for circulating ink is composed of the sub-tank 151, the supply flow path C2, the head unit 8, and the collection flow path C4.

In the sub-tank 151, a liquid level detection unit 151*a* composed of a plurality of pins is provided. The ink supply control unit 209 detects presence/absence of a conducting current between those pins so as to grasp a height of an ink liquid level, that is, an amount of remaining ink inside the sub-tank 151. A vacuum pump P0 is a negative pressure generating source for reducing pressure inside the sub-tank 151. An atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is made of a flexible member, and the volume change of the flexible member allows filling the sub-tank 151 with ink. The main tank 141 has a configuration removable from the printing apparatus body. In the midstream of a tank connection flow path C1 connecting the sub-tank 151 and the main tank 141, a tank supply valve V1 for switching connection between the sub-tank 151 and the main tank 141 is provided.

Under the above configuration, once the liquid level detection unit 151*a* detects that ink inside the sub-tank 151 is less than the certain amount, the ink supply control unit 209 closes the atmosphere release valve V0, a supply valve V2, a collection valve V4, and a head replacement valve V5 and opens the tank supply valve V1. In this state, the ink supply control unit 209 causes the vacuum pump P0 to operate. Then, the inside of the sub-tank 151 is to have a negative pressure and ink is supplied from the main tank 141 to the sub-tank 151. If the liquid level detection unit 151*a* detects that the amount of ink inside the sub-tank 151 is more than the certain amount, the ink supply control unit 209 closes the tank supply valve V1 to stop the vacuum pump P0.

The supply flow path C2 is a flow path for supplying ink from the sub-tank 151 to the head unit 8, and a supply pump P1 and the supply valve V2 are arranged in the midstream of the supply flow path C2. During print operation, driving the supply pump P1 in the state of the supply valve V2 being open allows ink circulation in the circulation path while supplying ink to the head unit 8. The amount of ink to be ejected per unit time by the head unit 8 varies according to image data. A flow rate set for the supply pump P1 is determined so as to be adaptable even in a case where the head unit 8 performs ejection operation in which ink consumption amount per unit time becomes maximum.

A relief flow path C3 is a flow path which is located in the upstream of the supply valve V2 and which connects between the upstream and downstream of the supply pump P1. In the midstream of the relief flow path C3, a relief valve V3 which is a differential pressure valve is provided. In a case where an amount of ink supply from the supply pump P1 per unit time is larger than the total value of an ejection amount of the head unit 8 per unit time and a flow amount (ink drawing amount) in a collection pump P2 per unit time, the relief valve V3 is released according to a pressure applied to its own. As a result, a cyclic flow path composed of a portion of the supply flow path C2 and the relief flow path C3 is formed. By providing the configuration of the above relief flow path C3, the amount of ink supply to the head unit 8 is adjusted according to the ink consumption amount by the head unit 8 so as to stabilize a pressure inside the circulation path irrespective of the image data.

The collection flow path C4 is a flow path for collecting ink from the head unit 8 to the sub-tank 151. In the midstream of the collection flow path C4, the collection pump P2 and the collection valve V4 are provided. At the time of ink circulation within the circulation path, the collection pump P2 sucks ink from the head unit 8 by serving as a negative pressure generating source. By driving the collection pump P2, an appropriate differential pressure is generated between an IN flow path 80*b* and an OUT flow path 80*c* inside the head unit 8, thereby causing ink to circulate from the IN flow path 80*b* to the OUT flow path 80*c*. A flow path configuration inside the head unit 8 will be described later in detail.

The collection valve V4 is a valve for preventing a backflow at the time of not performing print operation, that is, at the time of not circulating ink within the circulation path. In the circulation path of the present embodiment, the sub-tank 151 is disposed higher than the head unit 8 in a vertical direction (see FIG. 1). For this reason, in a case where the supply pump P1 and the collection pump P2 are not driven, there may be a possibility that ink flows back from the sub-tank 151 to the head unit 8 due to a water head difference between the sub-tank 151 and the head unit 8. In order to prevent such a backflow, the present embodiment provides the collection valve V4 in the collection flow path C4.

Similarly, at the time of not performing print operation, that is, at the time of not circulating ink within the circulation path, the supply valve V2 also functions as a valve for preventing ink supply from the sub-tank 151 to the head unit 8.

A head replacement flow path C5 is a flow path connecting the supply flow path C2 and an air layer (a part in which ink is not contained) of the sub-tank 151, and in its midstream, the head replacement valve V5 is provided. One end of the head replacement flow path C5 is connected to the upstream of the head unit 8 in the supply flow path C2 and the other end is connected to the upper part of the sub-tank 151 and is communicated with the air layer inside the sub-tank 151. The head replacement flow path C5 is used in the case of collecting ink from the head unit 8 in use such as upon replacing the head unit 8 or transporting the printing apparatus 1. The head replacement valve V5 is controlled by the ink supply control unit 209 so as to be closed except for a case of initial ink filling in the printing apparatus 1 and a case of collecting ink from the head unit 8. In addition, the above-described supply valve V2 is provided, in the supply flow path C2, between a connection point to the head replacement flow path C5 and a connection point to the relief flow path C3.

Next, a flow path configuration inside the head unit 8 will be described. Ink supplied from the supply flow path C2 to the head unit 8 passes through a filter 83 and then is supplied to a first negative pressure control unit 81 and a second negative pressure control unit 82. The first negative pressure control unit 81 is set to have a control pressure of a low negative pressure. The second negative pressure control unit 82 is set to have a control pressure of a high negative pressure. Pressures in those first negative pressure control unit 81 and second negative pressure control unit 82 are generated within a proper range by the driving of the collection pump P2.

In an ink ejection unit 80, a printing element substrate 80*a* in which a plurality of ejection openings are arrayed is arranged in plural to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in an arranging direction of the printing element substrates 80*a*. Furthermore, in the individual printing element substrates 80*a*, individual supply flow paths connected to the common supply flow path 80*b* and individual collection flow paths connected to the common collection flow path 80*c* are formed. Accordingly, in each of the printing element substrates 80*a*, an ink flow is generated such that ink flows in from the common supply flow path 80*b* which has relatively lower negative pressure and flows out to the common collection flow path 80*c* which has relatively higher negative pressure. In the midstream of a path between the individual supply flow path and the individual collection flow path, pressure chambers each of which is communicated with each ejection opening and filled with ink are provided. An ink flow is generated in the ejection opening and the pressure chamber even in a case where printing is not performed. Once the ejection operation is performed in the printing element substrate 80*a*, a part of ink moving from the common supply flow path 80*b* to the common collection flow path 80*c* is ejected from the ejection openings and is consumed. Meanwhile, ink not having been ejected moves toward the collection flow path C4 via the common collection flow path 80*c*.

Under the above configuration, in performing print operation, the ink supply control unit 209 closes the tank supply valve V1 and the head replacement valve V5 and opens the atmosphere release valve V0, the supply valve V2, and the collection valve V4 to drive the supply pump P1 and the collection pump P2. As a result, the circulation path in the order of the sub-tank 151, the supply flow path C2, the head unit 8, the collection flow path C4, and the sub-tank 151 is established. In a case where an amount of ink supply from the supply pump P1 per unit time is larger than the total value of an ejecting amount of the head unit 8 per unit time and a flow amount in the collection pump P2 per unit time, ink flows from the supply flow path C2 into the relief flow path C3. As a result, the flow amount of ink from the supply flow path C2 to the head unit 8 is adjusted.

In the case of not performing print operation, the ink supply control unit 209 stops the supply pump P1 and the collection pump P2 and closes the atmosphere release valve V0, the supply valve V2, and the collection valve V4. As a result, the ink flow inside the head unit 8 stops and the backflow caused by the water head difference between the sub-tank 151 and the head unit 8 is suppressed. Further, by closing the atmosphere release valve V0, ink leakage and ink evaporation from the sub-tank 151 are suppressed.

In the case of collecting ink from the head unit 8, the ink supply control unit 209 closes the tank supply valve V1, the supply valve V2, and the collection valve V4 and opens the atmosphere release valve V0 and the head replacement valve V5 to drive the vacuum pump P0. As a result, the inside of the sub-tank 151 becomes in a negative pressure state, and ink inside the head unit 8 is collected to flow back to the sub-tank 151 via the head replacement flow path C5. As such, the head replacement valve V5 is a valve being closed during normal print operation or at the time of standby and being open upon collecting ink from the head unit 8. In addition, the head replacement valve V5 is released even at the time of filling the head replacement flow path C5 with ink for an initial ink filling to the head unit 8.

Figure 10A:
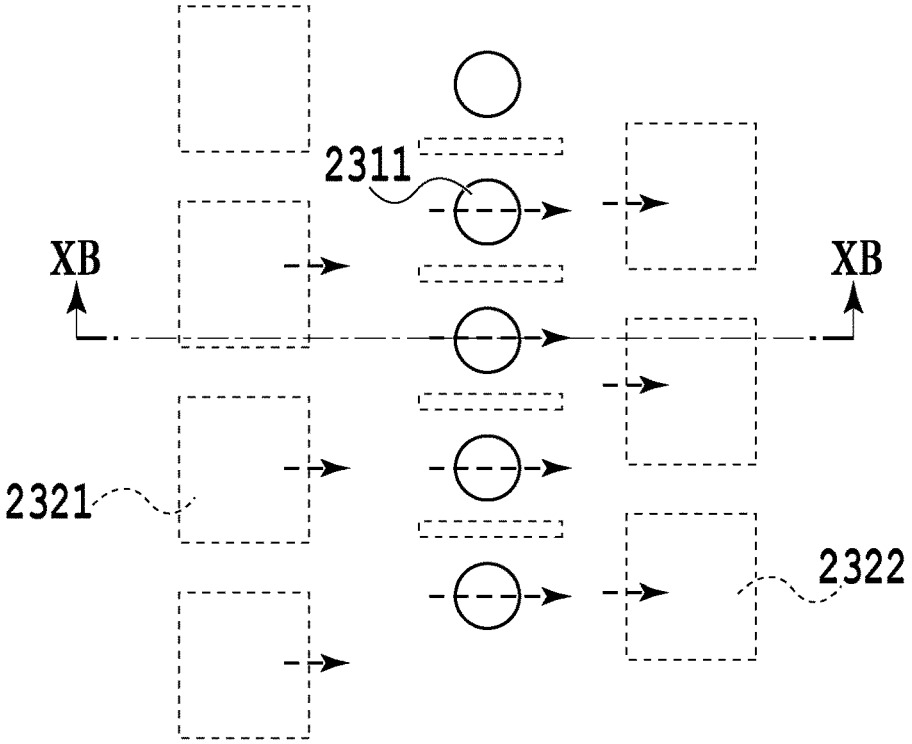
FIGS. 10A and 10B are diagrams showing an ink flow in a printing element substrate 80*a;*
Figure 10B:
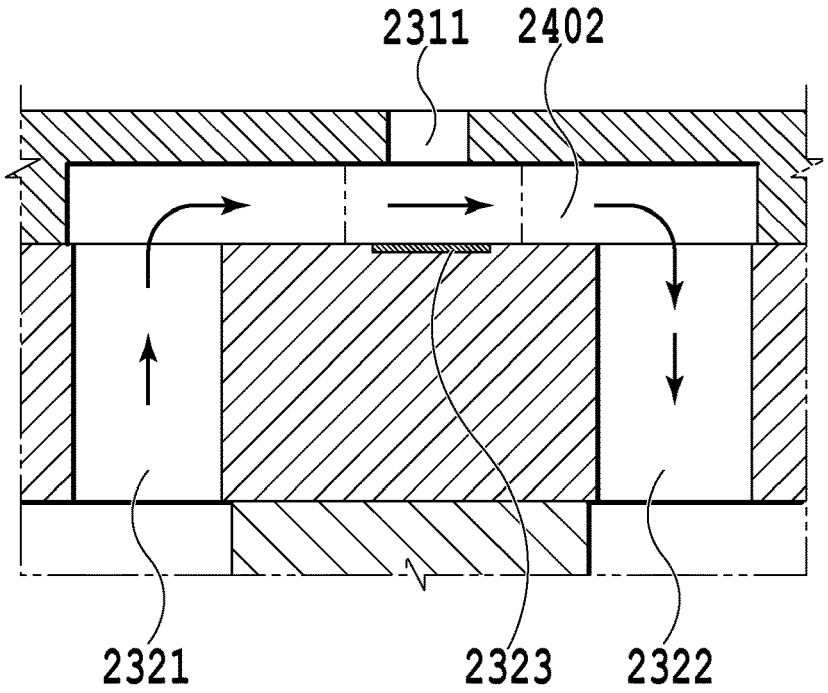

FIGS. 10A and 10B are diagrams illustrating an ink flow in a printing element substrate 80*a* of the head unit 8. FIG. 10A is an enlarged plan view viewing a part of the printing element substrate 80*a* from the ejection opening surface 8*a* side, and FIG. 10B is a sectional schematic view of a cross section taken from line XB-XB of FIG. 10A.

In the printing element substrate 80*a*, a pressure chamber 2402 which is filled with ink and an ejection opening 2311 from which ink is ejected are provided. In the pressure chamber 2402, an energy generation element 2323 is provided at a position facing the ejection opening 2311. Further, in the printing element substrate 80*a*, a plurality of ejection openings 2311 are formed, each of which is connected to an individual supply flow path 2321 which is connected to the common supply flow path 80*b* and an individual collection flow path 2322 which is connected to the common collection flow path 80*c*.

According to the above configuration, in the printing element substrate 80*a*, an ink flow is generated such that ink flows in from the common supply flow path 80*b* which has relatively lower negative pressure (high pressure) and flows out to the common collection flow path 80*c* which has relatively higher negative pressure (low pressure). To be more specific, ink flows in the order of the common supply flow path 80*b*, the individual supply flow path 2321, the pressure chamber 2402, the individual collection flow path 2322, and the common collection flow path 80*c*. Once ink is ejected by the energy generation element 2323, part of ink moving from the common supply flow path 80*b* to the common collection flow path 80*c* is ejected from the ejection opening 2311 to be discharged outside the head unit 8. Meanwhile, ink not having been ejected from the ejection opening 2311 is collected and flows to the collection flow path C4 via the common collection flow path 80*c*.

As such, in the printing element substrate 80*a* under print operation, ink constantly flows irrespective of print data or frequency of ejection from individual ejection openings, and at the ejection opening 2311, ink continuously supplied from the sub-tank 151 is exposed to atmosphere. Accordingly, there may be a concern that the entire circulating ink is concentrated compared to a configuration of not using an ink circulation system.

First Embodiment

The printing apparatus 1 of the present embodiment provides the ink circulation system described in FIG. 9, FIGS. 10A and 10B for each of cyan, magenta, yellow, and black inks, and each of the systems includes the supply pump P1 and the collection pump P2. The supply pumps P1 for four colors have one common supply motor as a driving source and the collection pumps P2 for the four colors have one common collection motor 500 as a driving source.

Figure 11:
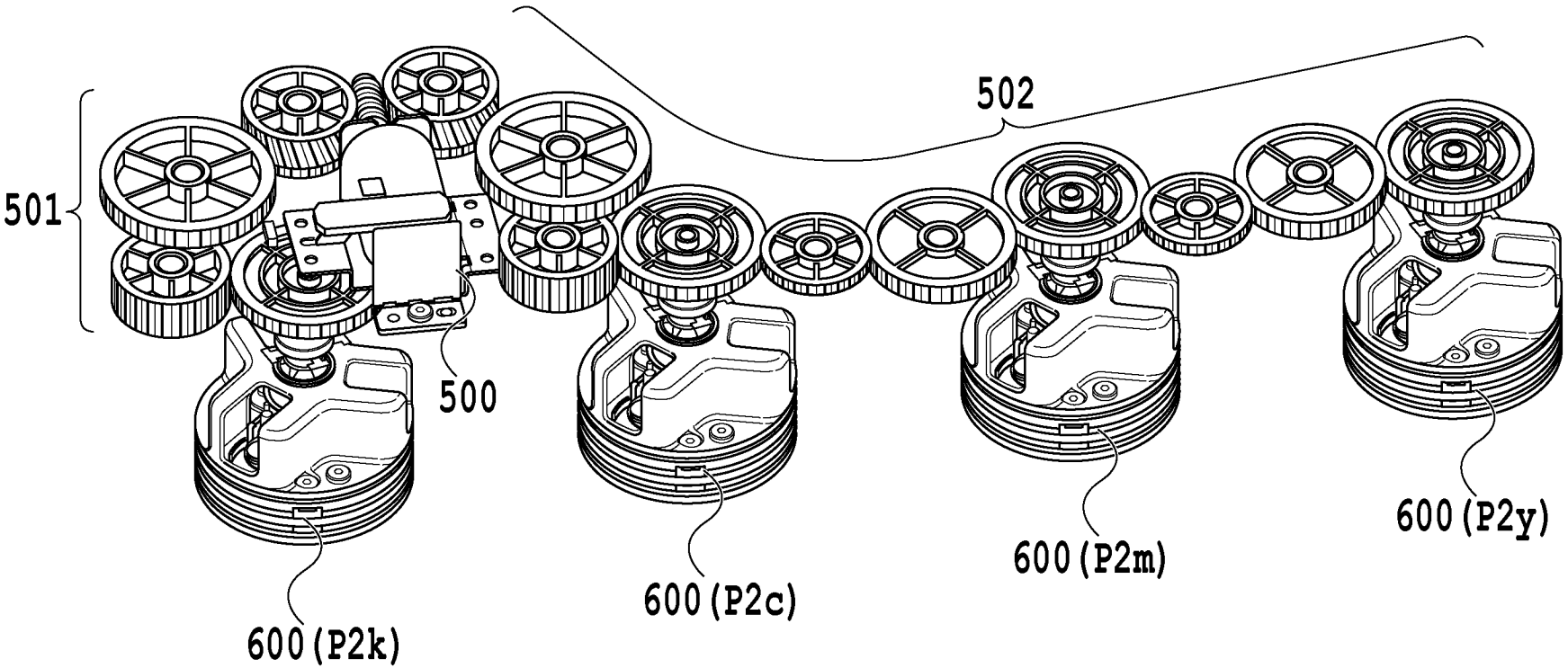
FIG. 11 is a diagram illustrating a connection mechanism of collection pumps according to a first embodiment.

FIG. 11 is a diagram for illustrating a mechanism of driving the collection pumps P2 for the four colors using the common collection motor 500. A collection pump for black ink (P2*k*), a collection pump for cyan ink (P2*c*), a collection pump for magenta ink (P2*m*), and a collection pump for yellow ink (P2*y*) are coupled to the collection motor 500. The collection pump for black ink (P2*k*) is driven by the collection motor 500 via a first gear train 501. The collection pump for cyan ink (P2*c*), the collection pump for magenta ink (P2*m*), and the collection pump for yellow ink (P2*y*) are driven by the collection motor 500 via a second gear train 502. These four collection pumps P2*k*, P2*c*, P2*m*, and P2*y* basically include the same structure. Meanwhile, the supply pumps P1 for the four colors are also composed of a supply pump for black ink (P1*k*), a supply pump for cyan ink (P1*c*), a supply pump for magenta ink (P1*m*), and a supply pump for yellow ink (P1*y*), all of which are coupled to the supply motor.

Figure 12A:
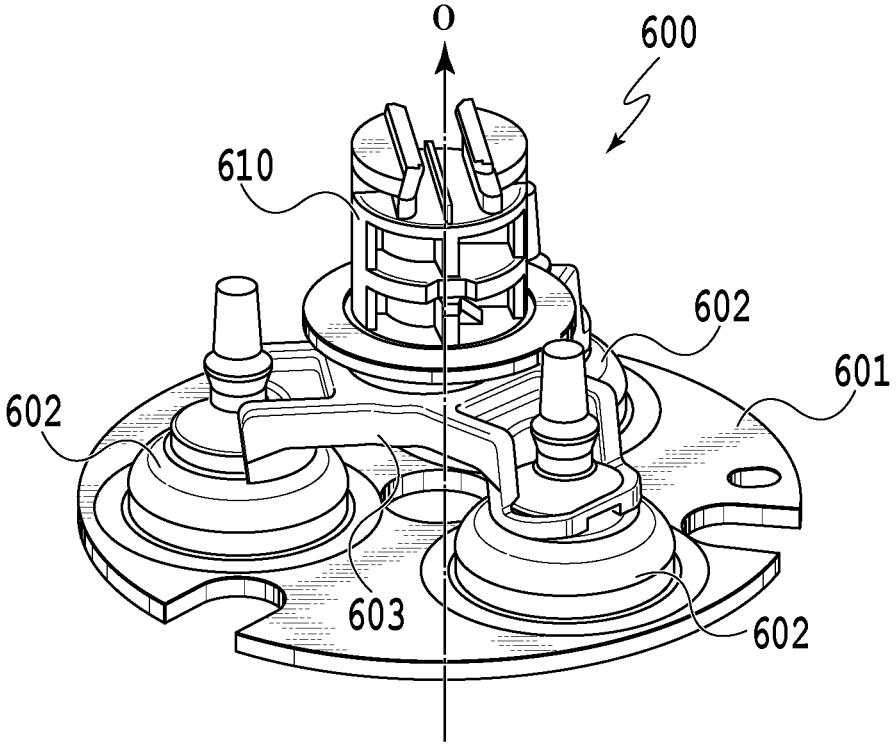
FIGS. 12A and 12B are diagrams showing a structure of a diaphragm pump.
Figure 12B:
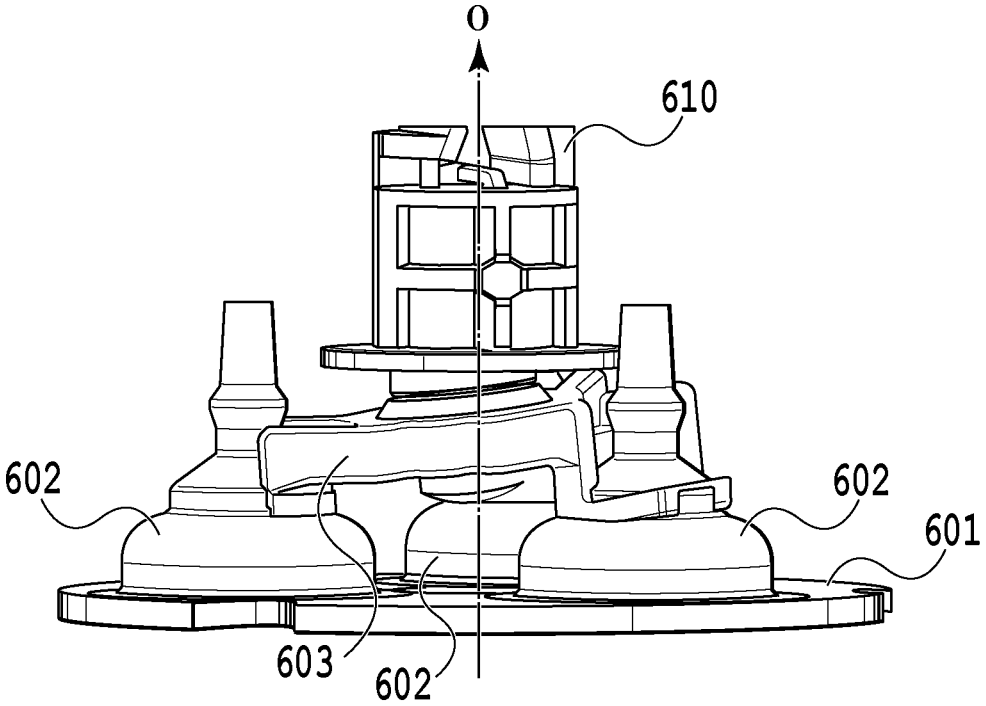

FIGS. 12A and 12B are diagrams showing a structure of a diaphragm pump 600 which is used for both the supply pump P1 and the collection pump P2. FIG. 12A is a perspective view of the diaphragm pump 600 and FIG. 12B is a side view thereof. Both show a state where a cover that is supposed to be mounted at the time of practical use is removed. The diaphragm pump 600 of the present embodiment is configured such that a control member 610 is mounted on a diaphragm unit (volume change portion) in which three diaphragms 602 are laid out on a supporting unit 601. Further, once a driving force of the supply motor or the collection motor 500 is transferred to the control member 610, the control member 610 rotates about an axis O that serves as a center and thus the three diaphragms 602 are pressed down in order by a pressing member 603 so as to generate an ink sucking force and an ink discharging force.

In the present embodiment, while using diaphragms 602 in the same type and with the same volume, the control member 610 to be mounted thereon for the supply pump P1 is made to be different from that for the collection pump P2 so that pump sucking forces applied onto the supply side and the collection side are adjusted to be different from each other.

FIGS. 13A to 13D are diagrams each showing the relation between the control member 610 and the diaphragm 602. The control member 610 is composed of the pressing member 603, a working shaft 604, and a strut 605. The strut 605 has a columnar shape and rotates about a rotational axis O that serves as a center of the strut along with the driving of the supply motor or the collection motor 500. One end of the rod-like working shaft 604 is inserted from the bottom face of the strut 605 with a predetermined angle θ with respect to the rotational axis O, and the other end is inserted into the center of the pressing member 603 extending in three directions. In such a structure, in the case where the strut 605 rotates along with the driving of the supply motor or the collection motor 500, the working shaft 604 rotates around the rotational axis O while retaining the predetermined angle θ with respect to the rotational axis O. Then, each of the pressing members 603 extending in three directions from the working shaft 604 presses the three diaphragms 602 in order.

In the control member 610, an angle θ of the working shaft 604 with respect to the rotational axis O and a length L of the pressing member 603 for the supply pump P1 differ from those for the collection pump P2. Accordingly, pressing amounts of the diaphragms 602 are made to be different, and thus the sucking amount and discharging amount of the pumps are adjusted. The supply pump P1*c* and collection pump P2*c* for cyan ink will be described below as an example.

Figure 13A:
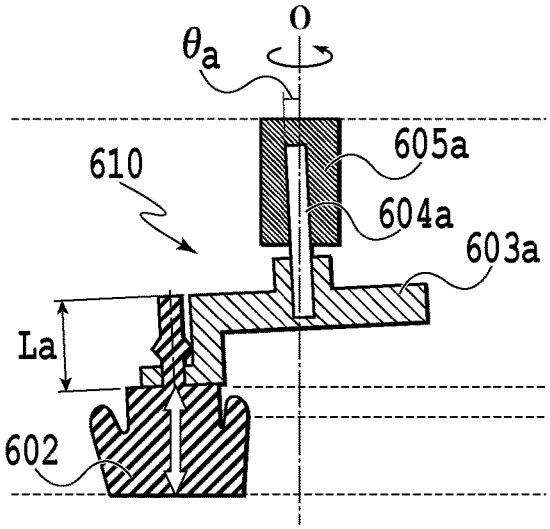
FIGS. 13A to 13D are diagrams showing the relation between a control member and a diaphragm 602.
Figure 13B:
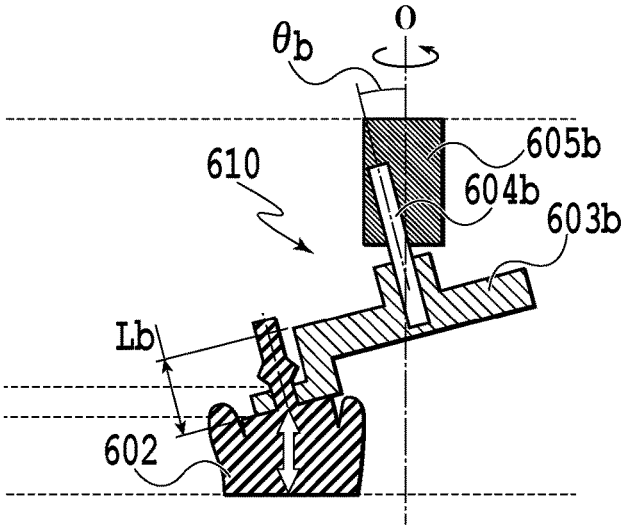
Figure 13C:
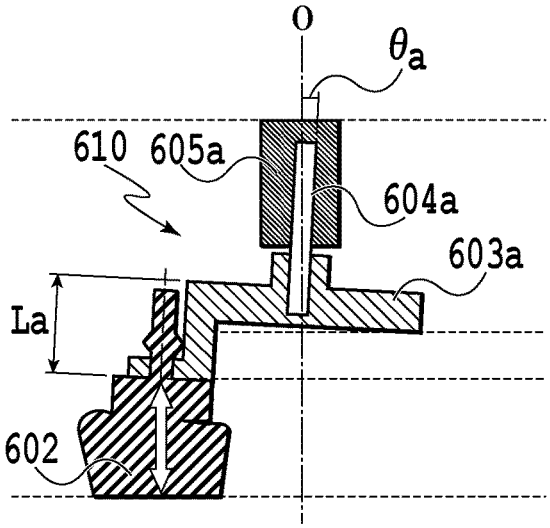
Figure 13D:
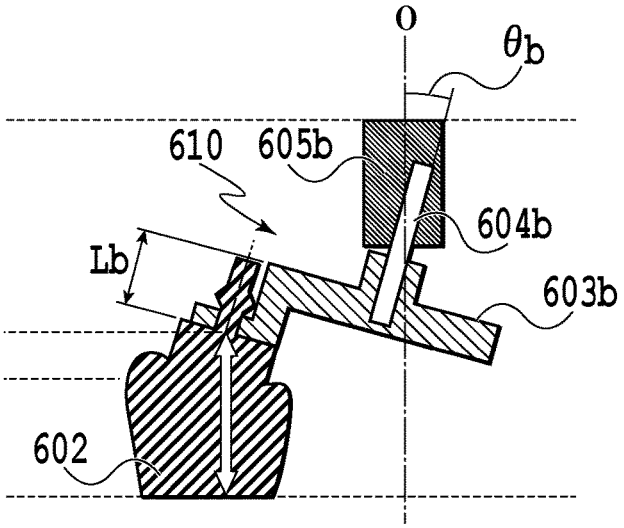

FIGS. 13A and 13B are cross-sectional views of pumps in rotational positions in which the largest pressing amounts are respectively applied onto the diaphragms 602. Specifically, FIG. 13A shows the collection pump P2*c* for the cyan ink and FIG. 13B shows the supply pump P1*c* for the cyan ink. FIGS. 13C and 13D are cross-sectional views of pumps in rotational positions in which the smallest pressing amounts are respectively applied onto the diaphragms 602, which correspond to positions where the working axes 604 have been rotated by 180 degrees from the states shown in FIGS. 13A and 13B. To be more specific, FIG. 13C shows the collection pump P2*c* for the cyan ink and FIG. 13D shows the supply pump P1*c* for the cyan ink.

Among members constituting the control member 610, the same member is used for the diaphragms 602 and the working axes 604 for the supply pumps P1 and the collection pumps P2. Meanwhile, the pressing member 603 for the supply pump P1 is configured to have a length different from that for the collection pump P2, and the strut 605 for the supply pump P1 is configured to have an angle θ for inserting the working shaft 604 different from that for the collection pump P2. As shown in FIGS. 13A to 13D, in the collection pump P2*c* for the cyan ink, an angle of the working shaft 604 with respect to the rotational axis O is denoted as θa and a length of the pressing member 603*a* is denoted as La. Meanwhile, in the supply pump P1*c* for the cyan ink, an angle of the working shaft 604 with respect to the rotational axis O is denoted as θb and a length of the pressing member 603*b* is denoted as Lb.

In the present embodiment, it is designed that the supply pump P1 has a larger angle θ of the working shaft 604 with respect to the rotational axis O (θa<θb), and the collection pump P2 has a larger length L of the pressing member 603 (La>Lb). As a result, in the states shown in FIGS. 13A and 13B, a larger pressing amount is applied onto the diaphragm 602 of the supply pump P1*c* for the cyan ink than that of the collection pump P2*c* for the cyan ink. Further, in the states shown in FIGS. 13C and 13D, a smaller pressing amount is applied onto the diaphragm 602 of the supply pump P1*c* for the cyan ink than that of the collection pump P2*c* for the cyan ink. In other words, the diaphragm 602 of the supply pump P1*c* for the cyan ink has a larger volume change per stroke than that of the collection pump P2*c* for the cyan ink, and consequently has a larger delivering amount of ink to be circulated within the circulation system.

As described above, in the diaphragm pump 600 of the present embodiment, ink sucking amount and ink discharging amount can be adjusted by using different control members 610 to be mounted while using the same type of diaphragm 602. As a result, the same type of parts can be used for the supply pump P1 and the collection pump P2 so as to reduce the cost.

As such, the example of setting different pump flow rates between the supply pump P1 and the collection pump P2 has been described, but the present invention may be applied to the supply pump P1 and the collection pump P2 having different flow rates by the respective ink colors. Further, one collection motor 500 is configured to drive the collection pumps P2*k*, P2*c*, P2*m*, and P2*y* for the four colors of ink, but each of the pumps may be driven by a dedicated motor. The same applies to the supply side.

More specifically, according to the present embodiment, flow amounts in the ink circulation system may be appropriately adjusted depending on a location of the circulation flow path or by each ink color in a manner of providing different types of control members 610 to be mounted on the same type of diaphragm 602.

Second Embodiment

As for a typical color inkjet printing apparatus, a monochrome mode which outputs black characters and line drawing and a color mode which outputs graphics and photos, for example, in full colors are prepared. In the color mode, all four color inks are used for printing. Meanwhile, in the monochrome mode, only a black ink is used and no color inks are used.

In a case of employing the above-described ink circulation system for such a color inkjet printing apparatus, there may be a possibility that circulating the color inks and the black ink simultaneously in the monochrome mode leads to further concentration of the color inks beyond necessity. As described above with reference to FIGS. 10A and 10B, since ink continuously supplied from the sub-tank 151 in the ink circulation system is exposed to atmosphere at the time of passing by the ejection openings, the evaporation of the color inks that are not actually subjected to ejection operation is promoted beyond necessity. For this reason, in the inkjet printing apparatus employing the ink circulation system, only inks that are actually subjected to ejection operation should preferably be appropriately circulated during such print operation. In view of the above situation, according to the present embodiment, a circulation method of the ink circulation system depending on printing modes is to be further varied in addition to the feature of the first embodiment.

Figure 14:
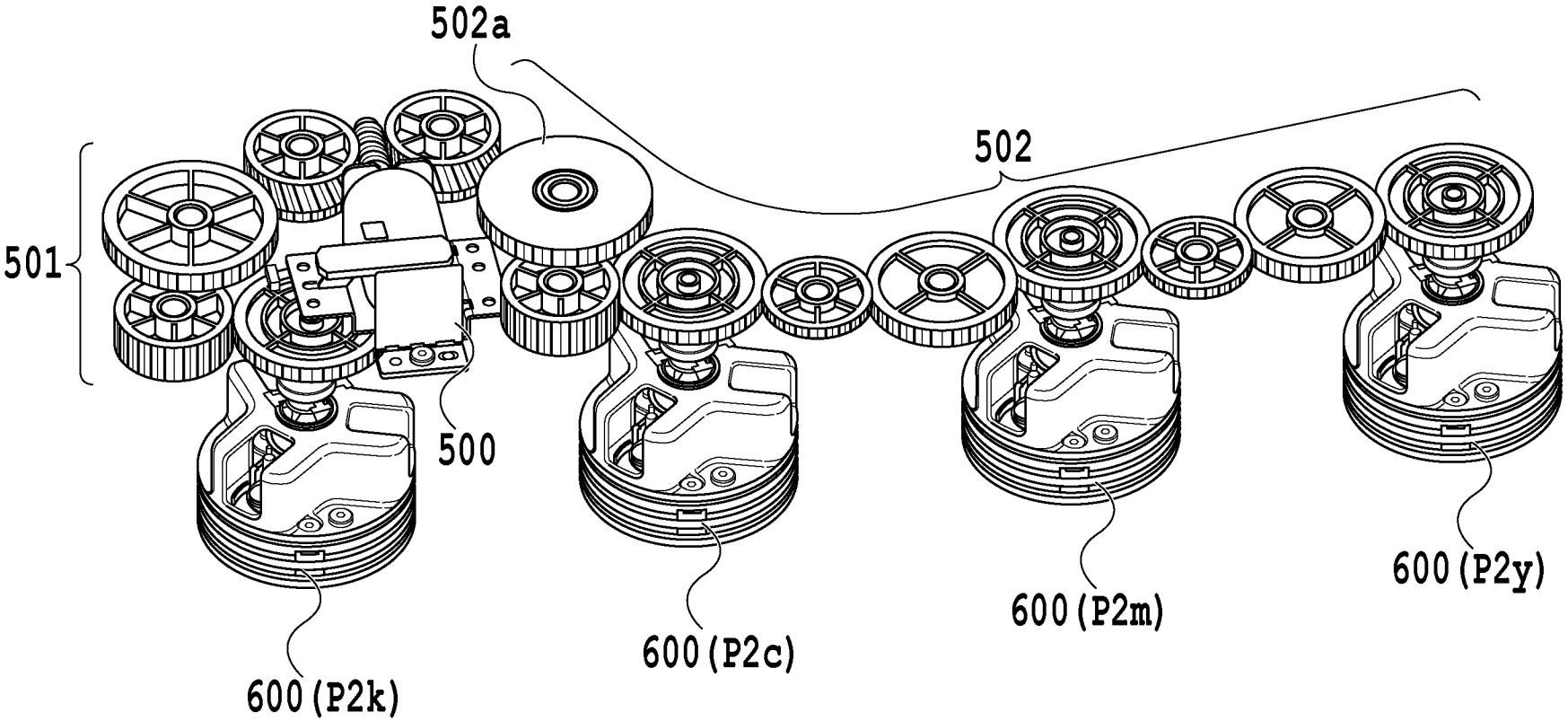
FIG. 14 is a diagram illustrating a connection mechanism of collection pumps according to a second embodiment.

FIG. 14 is a diagram showing a state of coupling the collection pumps P2 for four colors used in the present embodiment to the collection motor 500. A mechanism of the collection pumps P2*k*, P2*c*, P2*m*, and P2*y* corresponding to respective four color inks is identical to that of the first embodiment.

An aspect different from the case of FIG. 11 is that a one-way gear 502*a* is disposed at the beginning of the second gear train 502 which connects the collection motor 500 and the collection pumps P2*c*, P2*m*, and P2*y*. The one-way gear 502*a* transfers a driving force of the collection motor 500 upon its forward rotation to the collection pumps P2*c*, P2*m*, and P2*y*, but does not transfer a driving force of the collection motor 500 upon its reverse rotation. Accordingly, the collection pumps P2*c*, P2*m*, and P2*y* for the color inks are to be operated in the case where the collection motor 500 makes forward rotation, but are not to be operated in the case where the collection motor 500 makes reverse rotation. Meanwhile, the collection pump P2*k* for the black ink which is connected to the collection motor 500 via the first gear train 501 is operated irrespective of whether the collection motor 500 makes forward rotation or reverse rotation.

In the ink supply system of the present embodiment, the coupling mechanism shown in FIG. 14 is adopted for the collection pumps P2 for the four color inks, whereas the coupling mechanism shown in FIG. 11 is adopted for the supply pumps P1.

Figure 15A:
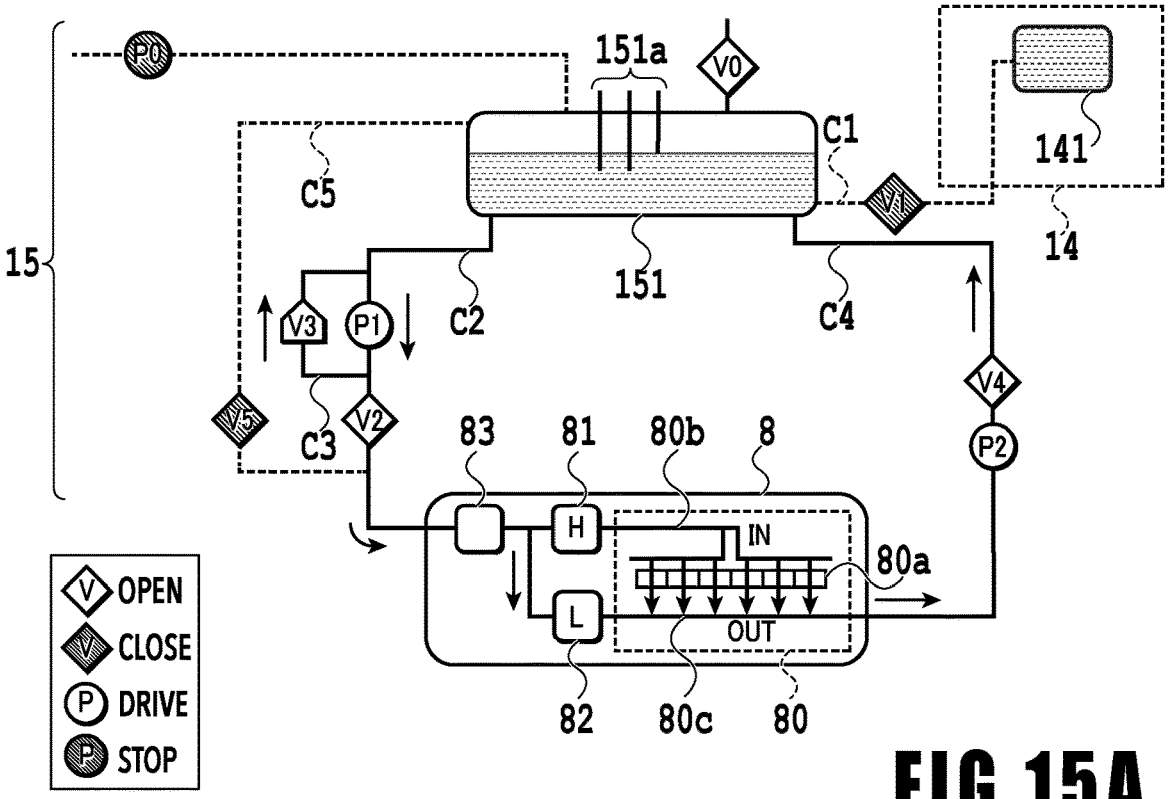
FIGS. 15A and 15B are diagrams of the relation between collection pump operation and ink circulation.
Figure 15B:
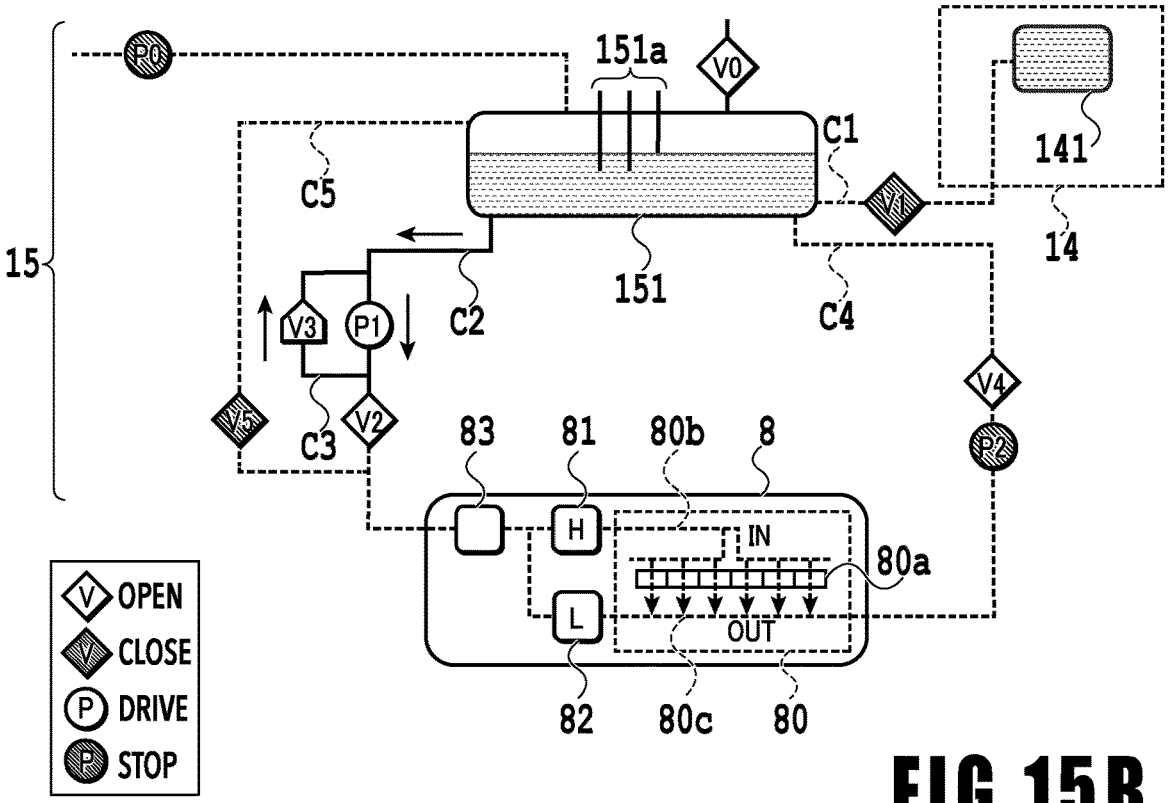

FIGS. 15A and 15B show the states of ink circulation in the cases of operating/not operating the collection pump P2 during the execution of print operation. FIG. 15A shows a state where the collection pump P2 is in operation, and FIG. 15B shows a state where the collection pump P2 is not in operation. It should be noted that, in the present embodiment, the one-way gear is not provided in the supply pump P1 side, and thus, the supply pump P1 is in operation for both cases shown in FIGS. 15A and 15B.

As shown in FIG. 15A, in the case where both the supply pump P1 and the collection pump P2 are in operation, ink contained in the sub-tank 151 flows through the supply flow path C2, the head unit 8, and the collection flow path C4 and returns to the sub-tank 151. Meanwhile, as shown in FIG. 15B, in the case where the supply pump P1 is in operation but the collection pump P2 is not in operation, the ink contained in the sub-tank 151 does not flow toward the head unit 8, but circulates within a circuit flow path which is composed of a portion of the supply flow path C2 and the relief flow path C3. A reason for this is that the stop of the collection pump P2 causes decrease in negative pressure in the collection flow path C4 side, thereby blocking the first negative pressure control unit 81 and the second negative pressure control unit 82.

In the present embodiment, in the case where the color mode is set, the collection pumps P2*k*, P2*c*, P2*m*, and P2*y* for all the colors are to be operated to achieve ink circulation as in FIG. 15A. In contrast, in the case where the monochrome mode is set, ink circulation shown in FIG. 15A is to be made for the black ink, while ink circulation shown in FIG. 15B is to be made for the color inks by way of not operating the collection pumps P2*c*, P2*m*, and P2*y*.

Figure 16:
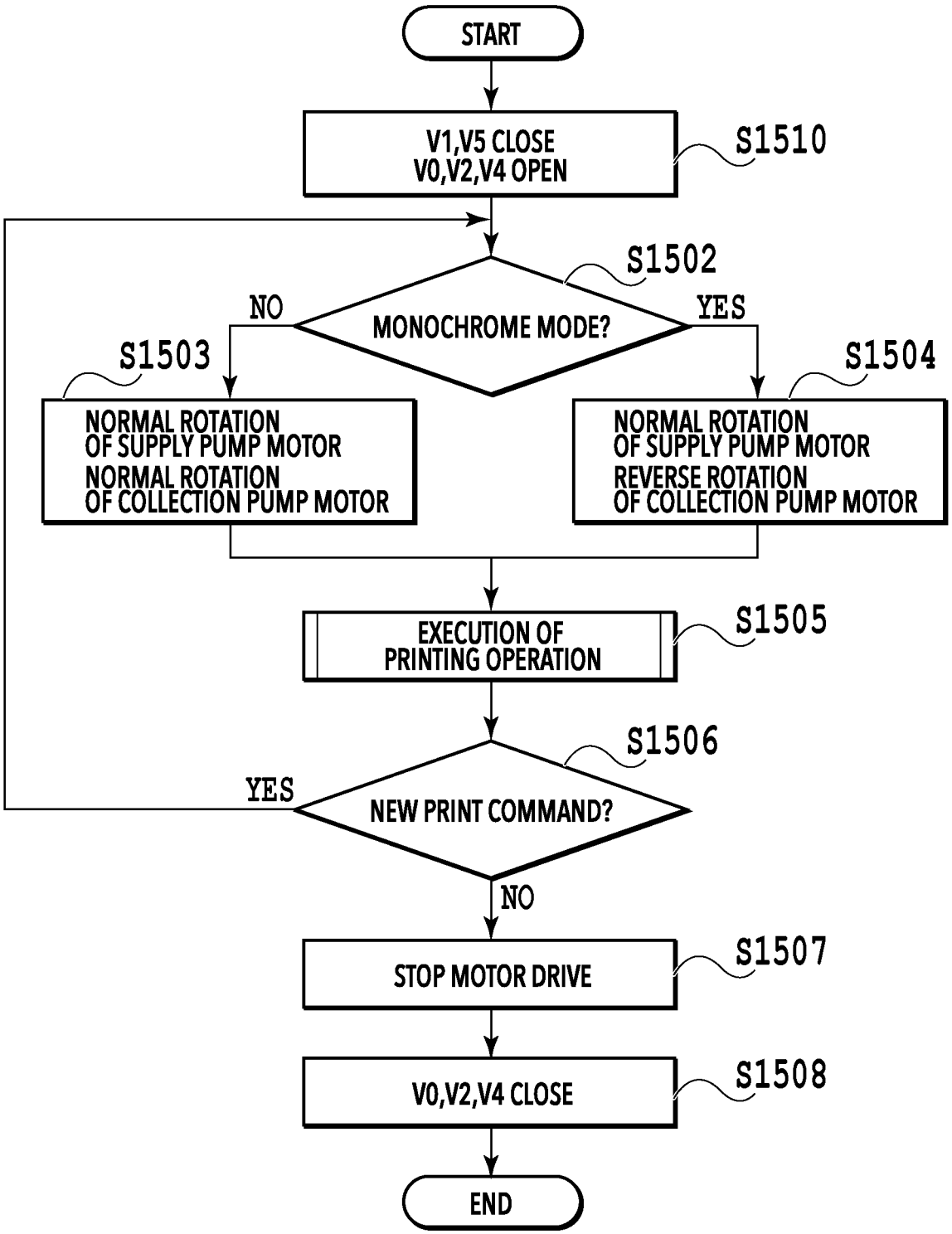
FIG. 16 is a flowchart illustrating processes in a case where a print command is inputted.

FIG. 16 is a flowchart, in a case where a print command is inputted from the host apparatus 400, for illustrating processes relating to ink circulation and print operation executed by the main controller 101 of the controller unit 100. With reference to FIGS. 15A and 15B, an explanation will be given below along with the flowchart of FIG. 16.

At the start of the processes, in Step S1510, the main controller 101 first makes initial setting for valves in the ink circulation system. To be more specific, as for the ink circulation system for all the colors, the ink supply control unit 209 closes the tank supply valve V1 and the head replacement valve V5 and opens the atmosphere release valve V0, the supply valve V2, and the collection valve V4.

In Step S1502, the main controller 101 determines whether a received print command specifies the monochrome mode or specifies the color mode. If the color mode is specified, the process advances to Step S1503, and if the monochrome mode is specified, the process advances to Step S1504.

In Step S1503, the main controller 101 causes the ink supply control unit 209 to control driving the supply motor for the supply pump P1 and the collection motor 500 for the collection pump P2 in forward rotation. Accordingly, in the ink circulation system for four colors, both the supply pump P1 and collection pump P2 are driven so as to generate ink flow shown in FIG. 15A.

In Step S1504, the main controller 101 causes the ink supply control unit 209 to control driving the supply motor in normal rotation and driving the collection motor 500 in reverse rotation. Accordingly, the supply pump P1 is operated in the ink circulation system for all the colors, but the collection pump P2 is operated in the ink circulation system only for the black ink but is not operated in the ink circulation system for the color inks. Consequently, in the ink circulation system for the black ink, ink flow shown in FIG. 15A is generated, whereas in the ink circulation system for the color inks, ink flow shown in FIG. 15B is generated.

In Step S1503 or Step S1504, in the case where ink circulation in accordance with the print mode is made, the process advances to Step S1505 where the main controller 101 makes predetermined print operation. In other words, the print controller 202 is used to cause the print head 8 to execute print operation in accordance with print data generated based on a received print command. In this case, in a case where the received print command indicates the monochrome mode, only the black ink is ejected from the print head 8. In a case where the received print command indicates the color mode, all of the four color inks are ejected from the print head 8.

After the completion of the print operation in Step S1505, the process advances to Step S1506 where the main controller 101 determines whether a new print job is received from the host apparatus 400. In the case of receiving the new print job, the process returns to Step S1502 where the main controller 101 starts a process for a next print command. Meanwhile, in the case where a new print command is not received, the process advances to Step S1507 where the main controller 101 causes the ink supply control unit 209 to stop the motor 500 for the supply pump P1 and the motor 500 for the collection pump P2.

The process further advances to Step S1508 where the main controller 101 causes the ink supply control unit 209 to close the atmosphere release valve V0, the supply valve V2, and the collection valve V4. As such, these processes are finished.

According to the present embodiment as described above, by providing the one-way gear and by switching the motor between forward rotation and reverse rotation, the presence/absence of ink circulation within the print head 8 can be switched according to each print mode with a relatively simple configuration. In other words, a stable ejection performance can be maintained by making ink circulation for the ink to be subjected to ejection operation. On the other hand, further ink evaporation and progress in concentration beyond necessity can be suppressed by stopping the ink circulation for the ink that is not subjected to ejection operation. Further, based on the above, the control members 610 to be mounted on the same type of diaphragm 602 are to be varied, as in the first embodiment, so as to enable appropriate adjustment of flow amounts in the ink circulation system depending on a location of the circulation flow path or by each ink color.

Incidentally, the one-way gear is disposed only in the collection pump P2 in the present embodiment, but the present invention is not limited to this. The one-way gear may be disposed in the supply pump P1 as well.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133621, filed Jul. 7, 2017, which is hereby incorporated by reference wherein in its entirety.

What is claimed is:

1. An inkjet printing apparatus comprising:

a print head configured to eject a first ink and a second ink;

a first tank in which the first ink is contained;

a second tank in which the second ink is contained;

a first pump for circulating the first ink in a first circulation route including the first tank and the print head;

a second pump for circulating the second ink in a second circulation route including the second tank and the print head; and a switching unit for switching between a first mode for driving the first pump and the second pump and a second mode for driving the first pump and not driving the second pump.

2. The inkjet printing apparatus according to claim 1, wherein the first ink is a black ink, the second ink is a color ink, the first mode is a color mode in which the black ink and the color ink are ejected from the print head, and the second mode is a monochrome mode in which the black ink is ejected and the color ink is not ejected.

3. The inkjet printing apparatus according to claim 1, further comprising a driving source configured to drive the first pump and the second pump, wherein the switching unit includes a one-way gear which transfers, to the second pump, a driving force of the driving source that makes forward rotation in the first mode, and which does not transfer, to the second pump, a driving force of the driving source that makes reverse rotation in the second mode.

4. The inkjet printing apparatus according to claim 1, wherein the print head includes:

a first ejection opening for ejecting the first ink;

a second ejection opening for ejecting the second ink;

a first pressure chamber in which the first ink to be ejected from the first ejection opening is contained;

a second pressure chamber in which the second ink to be ejected from the second ejection opening is contained;

a first print element configured to apply energy for ejecting the first ink contained in the first pressure chamber; and a second print element configured to apply energy for ejecting the second ink contained in the second pressure chamber.

5. The inkjet printing apparatus according to claim 4, wherein the first circulation route includes the first pressure chamber and the second circulation route includes the second pressure chamber.

6. The inkjet printing apparatus according to claim 1, wherein the print head has ejection openings for ejecting ink that are arranged so as to correspond to the width of a print medium.

7. A control method for an inkjet printing apparatus including a print head configured to eject a first ink and a second ink, a first tank in which the first ink is contained, a second tank in which the second ink is contained, a first pump for circulating the first ink in a first circulation route including the first tank and the print head, a second pump for circulating the second ink in a second circulation route including the second tank and the print head, the control method comprising:

a switching step of switching between a first mode for driving the first pump and the second pump and a second mode for driving the first pump and not driving the second pump.

8. The control method according to claim 7, wherein the first ink is a black ink, the second ink is a color ink, the first mode is a color mode in which the black ink and the color ink are ejected from the print head, and the second mode is a monochrome mode in which the black ink is ejected and the color ink is not ejected.

9. The control method according to claim 7, wherein the inkjet printing apparatus includes a driving source driving the first pump and the second pump and a switching unit having a one-way gear which transfers, to the second pump, a driving force of the driving source that makes forward rotation in the first mode, and which does not transfer, to the second pump, a driving force of the driving source that makes reverse rotation in the second mode.

10. The control method according to claim 7, wherein the print head includes a first ejection opening for ejecting the first ink, a second ejection opening for ejecting the second ink, a first pressure chamber in which the first ink to be ejected from the first ejection opening is contained, a second pressure chamber in which the second ink to be ejected from the second ejection opening is contained, a first print element configured to apply energy for ejecting the first ink contained in the first pressure chamber; and a second print element configured to apply energy for ejecting the second ink contained in the second pressure chamber.

11. The control method according to claim 10, wherein the first circulation route includes the first pressure chamber and the second circulation route includes the second pressure chamber.

12. The control method according to claim 7, wherein the print head has ejection openings for ejecting ink that are arranged so as to correspond to the width of a print medium.

13. A print head capable of being mounted on an inkjet printing apparatus that includes a first tank in which a first ink is contained, a second tank in which a second ink is contained, a first pump for circulating the first ink in a first circulation route including the first tank, a second pump for circulating the second ink in a second circulation route including the second tank, and a switching unit for switching between a first mode for driving the first pump and the second pump and a second mode for driving the first pump and not driving the second pump, the print head comprising:

a first ejection opening for ejecting the first ink supplied from the first tank;

a second ejection opening for ejecting the second ink supplied from the second tank;

a first pressure chamber included in the first circulation route, through which the first ink is circulated between the first pressure chamber and the first tank by driving the first pump;

a second pressure chamber included in the second circulation route, through which the second ink is circulated between the second pressure chamber and the second tank by driving the second pump;

a first print element configured to apply energy for ejecting the first ink contained in the first pressure chamber; and a second print element configured to apply energy for ejecting the second ink contained in the second pressure chamber.

14. The print head according to claim 13, wherein the first ink is a black ink, the second ink is a color ink, the first mode is a color mode in which the print head ejects the black ink and the color ink, and the second mode is a monochrome mode in which the print head ejects the black ink and does not eject the color ink.

15. The print head according to claim 13, wherein ejection openings for ejecting ink that are arranged so as to correspond to the width of a print medium.

* * * * *